United States Patent [19]

Parker

[11] Patent Number: 5,063,944

[45] Date of Patent: Nov. 12, 1991

[54] METHOD AND APPARATUS FOR SEPARATION OF OBJECTIONABLE PARTICLES FROM TOBACCO MATERIAL

[75] Inventor: Michael P. Parker, Leighton Buzzard, England

[73] Assignee: Rothmans International Tobacco (UK) Limited, United Kingdom

[21] Appl. No.: 411,134

[22] Filed: Sep. 22, 1989

[30] Foreign Application Priority Data

Sep. 28, 1988 [GB] United Kingdom ..... 8822723

[51] Int. Cl.[5] ..... A24B 3/06; A24B 3/18

[52] U.S. Cl. ..... 131/109.2; 131/109.3; 131/110

[58] Field of Search ..... 131/110, 300, 108, 296, 131/291, 302, 303, 304

[56] References Cited

U.S. PATENT DOCUMENTS

| | | | |
|---|---|---|---|
| 3,549,293 | 12/1970 | Wiide et al. | 131/110 |
| 4,815,482 | 3/1989 | Clift et al. | 131/300 |
| 4,932,424 | 6/1990 | Liebe et al. | 131/304 |

*Primary Examiner*—V. Millin

*Attorney, Agent, or Firm*—Diller, Ramik & Wight

[57] ABSTRACT

A method of separating objectionable particles from host tobacco material which includes fluidizing the tobacco material with a fluidizing air stream to allow heavy unwanted particles to fall, to cause light unwanted particles to rise and be air transported away and to leave a carpet of acceptable material.

13 Claims, 9 Drawing Sheets

METHOD AND APPARATUS FOR SEPARATION OF OBJECTIONABLE PARTICLES FROM TOBACCO MATERIAL

BACKGROUND OF THE INVENTION

This invention relates to a method and apparatus for separation of objectionable particles from tobacco material, for example from cut or un-cut tobacco.

The objectionable particles may be "heavies", for example coarse cut stem pieces and/or "lights", for example particles of dust.

In processing, different tobacco components are treated in different ways before being combined to form the final blend. For example, lamina undergoes a different conditioning treatment to stem and is cut more finely. If there is some cross-contamination of tobacco type such as stem on lamina or lamina on stem, problems will occur after cutting. After cutting, some of the stem in lamina will be so coarsely cut it will be deemed to be objectionable and some of the lamina will be so finely cut it will, in the latter stages of processing, be rendered to dust. For the maintenance of quality, both the overtly large and small particles must be removed from the tobacco prior to being manufactured into the cigarette rod.

One way of removing objectionable particles has been provided for in cigarette making machines, in that prior to forming the unwrapped cigarette rod, the tobacco in the machines is passed through a winnower and air lifted. In passing through the winnower, some heavy objectionable particles are removed. In air lifting, some of the dust passes through the machine to be removed by filtration before the air is exhausted to the atmosphere. Both of these processes are inefficient and remove only a portion of the objectionable material present. Their efficiency is also load dependent, that is, the more objectionable material present, the lower their efficiency. Their discrimination of the winnows is also poor, resulting in acceptable material being rejected with the objectionable.

Another method of removing objectionable material for example is to classify it out by air lifting. There are several styles of classification in existence. These work on the principle that the heavy particles can be separated from the light particles by passing them through a moving stream of air which carries the light particles off with it for separation later, while the heavy particles due to their mass/aerodynamic qualities ar left behind.

As the light particles are usually the acceptable and less robust portion of the tobacco and the air velocities used are in the order of 3,000 ft/min or higher, this form of separation usually results in some degradation of the good tobacco components. Again discrimination between heavy and light particles is poor due to the aerodynamic shadowing and the very short time in which separation occurs.

U.S. Pat. No. 4,646,759 shows apparatus for the separation of tobacco into two fractions, for example "heavies" and "lights". The tobacco is supplied to a separator unit including a vibrating conveyer and streams of air rising through the conveyer plate lift the lighter particles away. The particles most desirable for use as cigarette filler are pulled away and into an upper collector chamber and there deposited into a collector tray leaving the heavy particles to be discharged separately.

SUMMARY OF THE INVENTION

The general objective of the present invention is to effectively separate the objectionable particles from the acceptable tobacco product by a means which does not cause the acceptable tobacco components to degrade.

Specifically the objectives are:

To remove heavy objectionable particles such as coarse or uncut stem or heavy foreign objects from tobacco.

To remove light objectionable particles such as dust from tobacco.

To cool, condition or maintain the physical status of the host tobacco during the separation of the above.

To effect the above without degrading the host tobacco.

According to the present invention a method of separating objectionable particles from host tobacco material includes fluidising the tobacco material with a fluidising air stream to allow heavy unwanted particles to fall, to cause light unwanted particles to rise and be air transported away and to leave a carpet of acceptable material.

Preferably the method incudes agitating the tobacco material whilst it is fluidised.

The vertical air velocity across the working zone of the bed can be low and can change from as little as 300 ft/min to 1000 ft/min, and the combination of agitation and air flow causes the tobacco to stratify and be teased open so that the dust is lifted away and the heavy particles sink to the lower strata. The average fluidised air velocity is set such that the heavy particles cannot be supported by the air flow and consequently sink.

The advantage of the invention is that the tobacco components are fluidised in the fluidising air stream rather than air-lifted and transported, and as such have more time to discretely separate and do not suffer the degradation found in other separation systems.

If desired however the acceptable material may be gently air transported from the carpet. Thus sufficient time is allowed for the particles to become aerodynamically supported and separated with the acceptable material then finally being carried on a gentle air stream and lifted from the carpet and transported and as such do not suffer the same degradation found in other separation systems.

The invention also incudes apparatus for the separation of objectionable particles from tobacco material comprising means for fluidising the material to form a carpet in a fluidising air stream, means for simultaneously agitating the material to release the dust and heavy particles, arranging the air flow velocity to cause the dust to rise and heavy particles to sink from said carpet, and means for removing said dust and said heavy particles.

If desired means can be incorporated for lifting the acceptable material from the carpet on a gentle removal air stream and transporting it.

Preferably the said fluidising air stream forms a fluidised bed on a deck which is vibrated to cause agitation of the tobacco.

In a preferred embodiment, the said fluidised bed deck has a convoluted and at least partly perforated surface which provides peaks and troughs, the air velocity of said fluidising air stream being arranged to cause a portion of the tobacco carpet to be below the peaks but spaced above the bottoms of the troughs. As the deck is convoluted, the air volume to deck area within the bed is higher than that at the troughs of the convolutions, the resultant air velocity being such that the bottom of the fluidised carpet of the tobacco is supported below the peaks of the convolutions, teasing via the vibratory bed is effected throughout the whole tobacco carpet.

The heavy particles can be removed through openings in the deck and thus the openings can be in the form of slots in the troughs.

The heavy particles can be arranged to pass through the slots to a collector which moves them to at least one side or end of the vibratory deck.

The tobacco carpet can be transported by the fluidising deck to a position where the acceptable tobacco can be transferred by gravity onto a take off conveyer.

Alternatively the tobacco carpet can be transported by the fluidising deck to a position where the acceptable particles are gently air lifted via one or more suctions tubes at such a low velocity as to leave any remaining heavy particles behind and to be further transported to the end of the deck.

The dust can be removed through a tapered extraction hood in which the air velocity at its higher level is less than the air velocity at its lower level thus ensuring that only dust can be entrained.

If desired, the heavy particles can be delivered to a classifier for segregation and re-cycling.

Preferably means are provided for smoothing the flow of and pre opening the incoming tobacco. This can take the form of spreading on a vibrating deck using deflectors followed by passing the material across an air stream or by using a spiked belt or spiked roller; again this may be followed by passing the material across an air stream.

The invention can be performed in various ways and various embodiments will now be described by way of example and with reference to the accompanying drawings in which:

DESCRIPTION OF THE PREFERRED EMBODIMENTS

Figure 1:
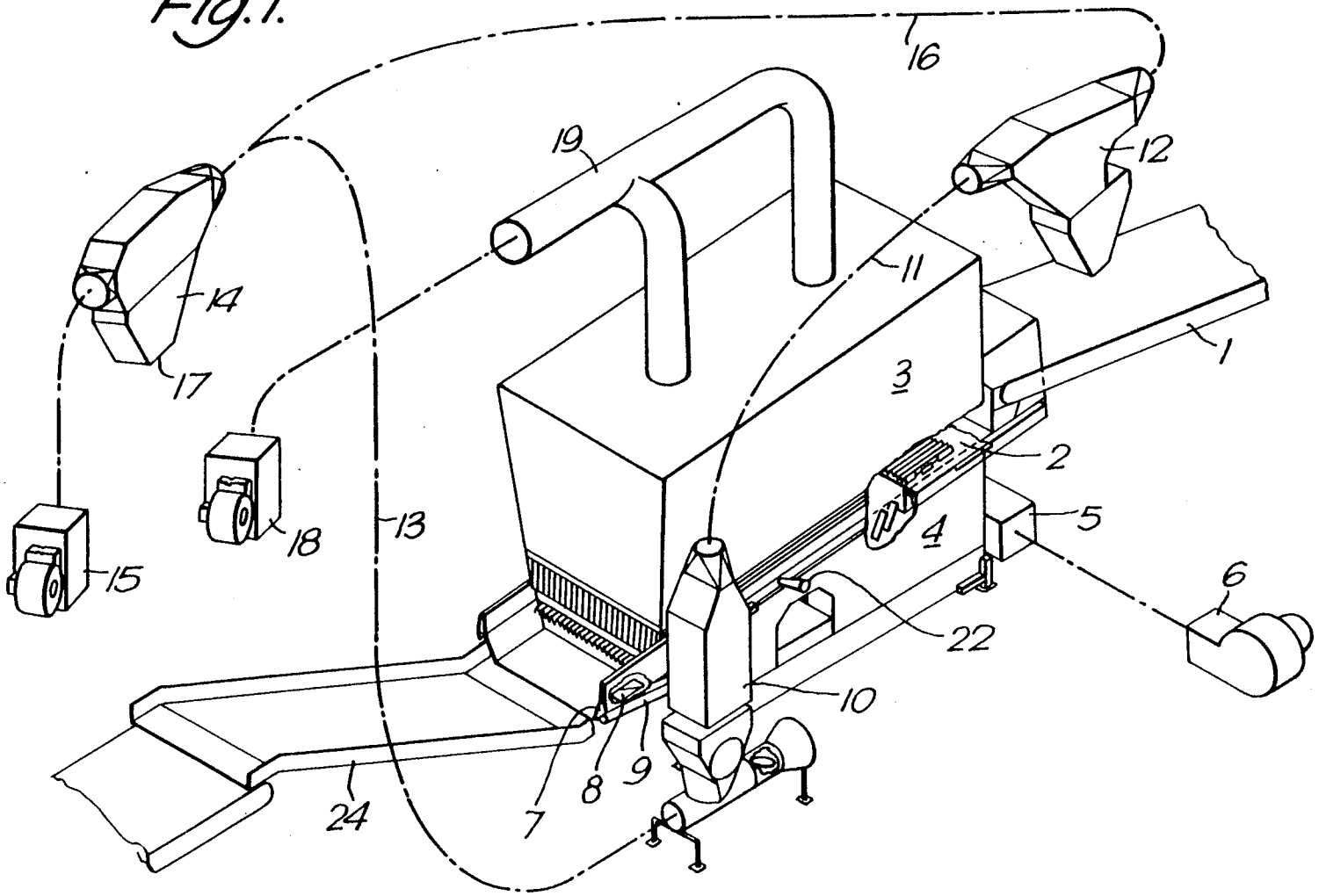
FIG. 1 is a diagrammatic view of a first embodiment of the apparatus according to the invention.

As shown in FIG. 1 of the drawings, the apparatus comprises a feed conveyer 1, which transports tobacco material to be treated onto a vibrating fluid bed deck 2. If desired, the tobacco having left conveyer 1 can be teased by a stream of air which acts to spread, separate and untangle the material As the material reaches the deck 2, means can be provided to further spread it evenly over the full deck width, for example by means of a baffle (not shown). The deck 2 is inclined and its vibratory action causes the tobacco to be transported along it. A flared hood 3 is provided and beneath the hood a combination of perforated and/or perforated and plain, and perforated sheets with slots is used to cause the tobacco to become fluidised with the combination of the deck's vibrating action and air velocity introduced from a plenum 4 beneath the deck 2. Air is introduced into the plenum through suitable ducting 5 from a fan 6.

The deck 2 beneath the hood 3 is corrugated to provide higher air velocity at its peaks than in its troughs. Heavy particles fall through the fluidised carpet of tobacco thus produced which is teased open by the action of the air and vibration and fall into the troughs between the peaks of the corrugated bed. Slots (to be described in more detail) are provided through which the heavy particles fall, and the air-flow through the slots is set so that it cannot support the heavy objectionable material.

Collectors (not shown in FIG. 1) are arranged beneath the slots which transport the heavy material to a gallery 7 at one side of the bed 2 and the material progresses down the gallery to a window 8 through which it falls onto a conveyer 9. Conveyer 9 lifts the particles to a classifier 10 where any acceptable tobacco in the heavy particles is segregated and re-cycled by being passed through a ducting 11 to a separator 12 through which it is returned to the loading conveyer 1. Heavy objectionable particles are dropped out of the bottom of the classifier 10 and are passed through ducting 13 to a separator 14 from which they are ejected at 17. An extraction fan filter is indicated by reference numeral 15. Ducting 16 returns air from the separator 12 via the separator 14 to the fan filter 15.

Light objectionable particles such as dust are lifted above the top of the fluidised carpet of tobacco by the air-stream and taken to a fan-filter 18 via extraction ducting 19 leading from the top of the hood 3. As the hood 3 is flared from bottom to top, the air velocity within it is reduced from bottom to top. This prevents the fluidised carpet of tobacco from being lifted beyond fluidisation and ensures that any acceptable particles of tobacco entrained in the fluidised air drop out as its velocity reduces before it is extracted from the hood 3.

The air used to fluidise the tobacco can be of a specific temperature and RH to influence the final temperature and moisture of the tobacco at the discharge end of the vibrating bed 2.

Throughout the whole process, the bulk of the acceptable tobacco is supported on a cushion of air which produces the fluidisation required and this gentle form of support prevents the host tobacco from degrading.

Figure 2:
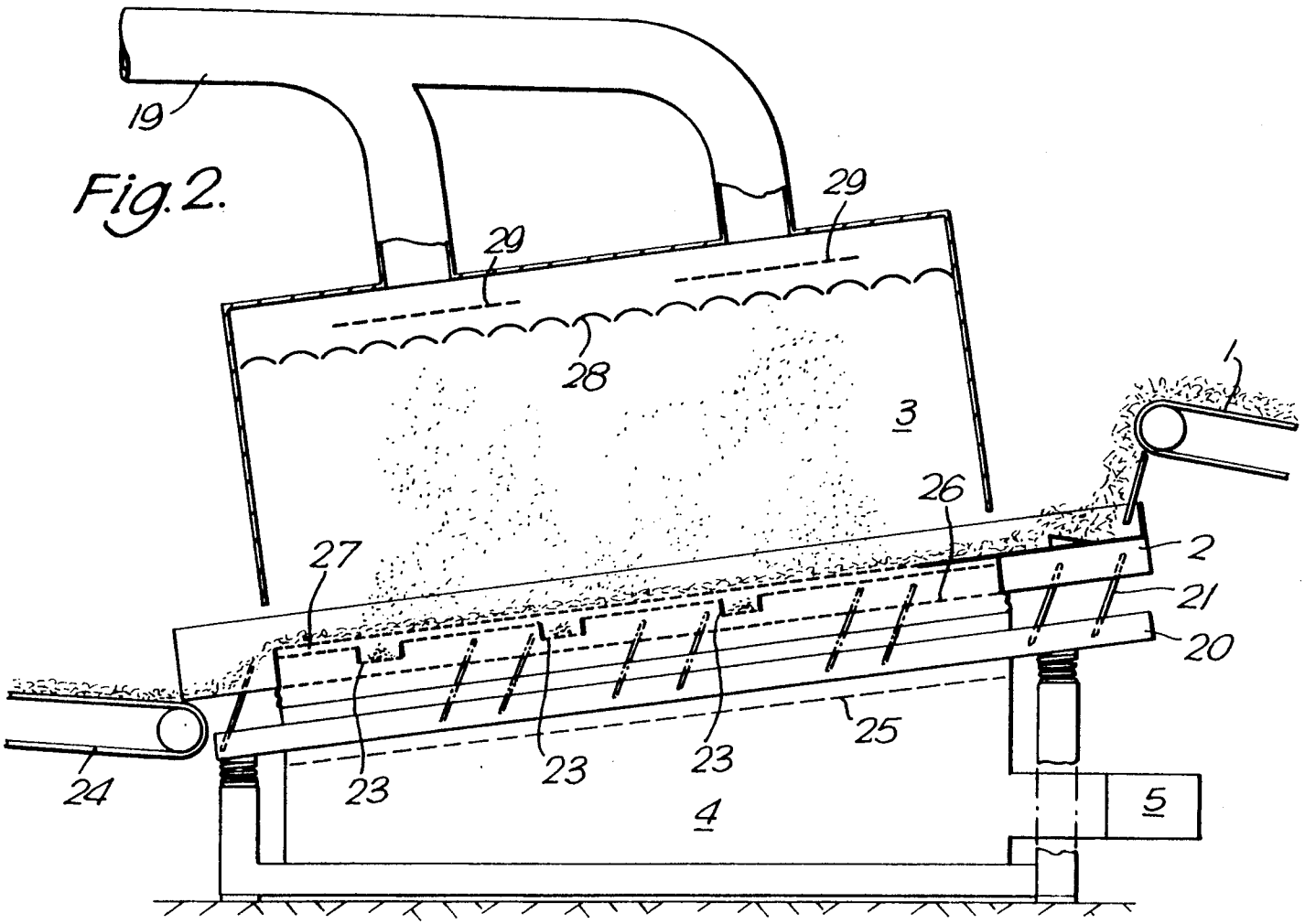
FIG. 2 is a diagrammatic cross-section through part of the apparatus shown in FIG. 1.

FIG. 2 is a diagrammatic cross-sectional view of part of the apparatus and the same numerals are used to indicated similar parts as in FIG. 1. As will be seen from FIG. 2, the vibrating deck 2 is carried on a spring-mounted frame to which it is connected by fiberglass springs 21. The deck is vibrated by a drive-arm 22 as shown in FIG. 1 and the collectors of the "heavies" are shown as channels 23. The cleaned, cut lamina emerging from the deck is delivered to a removal conveyer 24. Reference numeral 25 indicated a baffle in the plenum which acts to distribute air and reference numeral 26 indicates a further baffle in the base of the deck. The convoluted deck is preferably made with a 10% open area from perforated sheet and is indicated by reference numeral 27, but larger or smaller cores of perforation could be used.

An air deflector 28 is provided in the upper part of the hood 3 and baffles are indicated by reference numeral 29.

Figure 3:
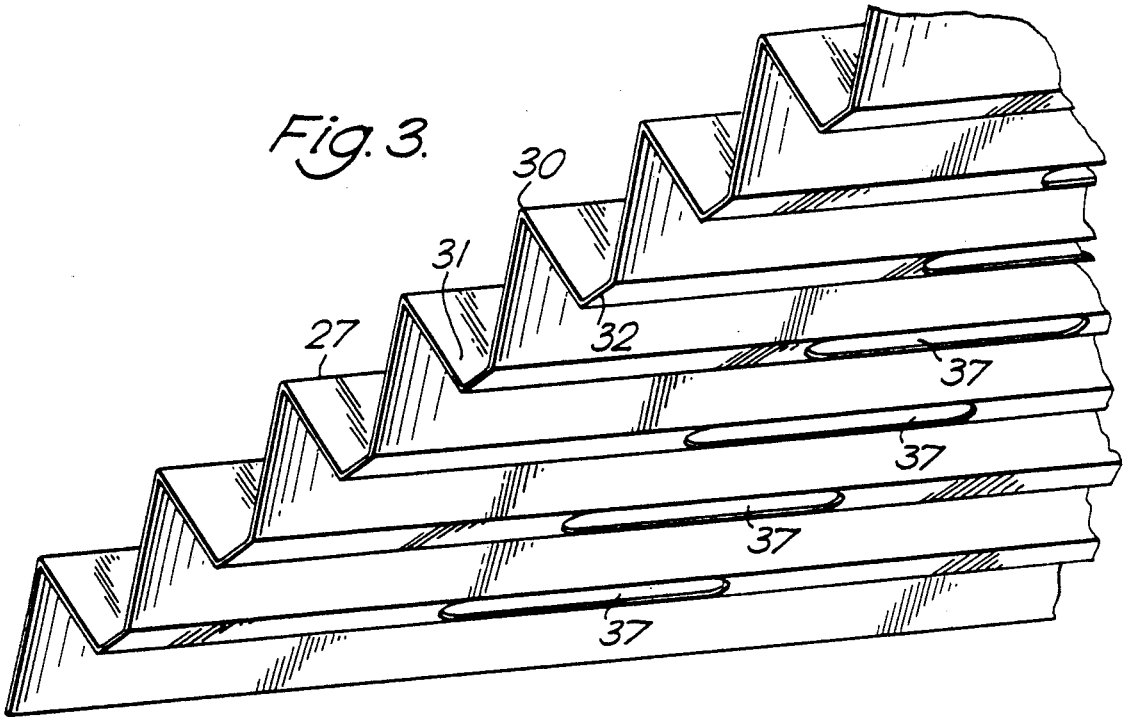
FIG. 3 is an enlarged isometric view of part of the fluidised bed deck.
Figure 7:
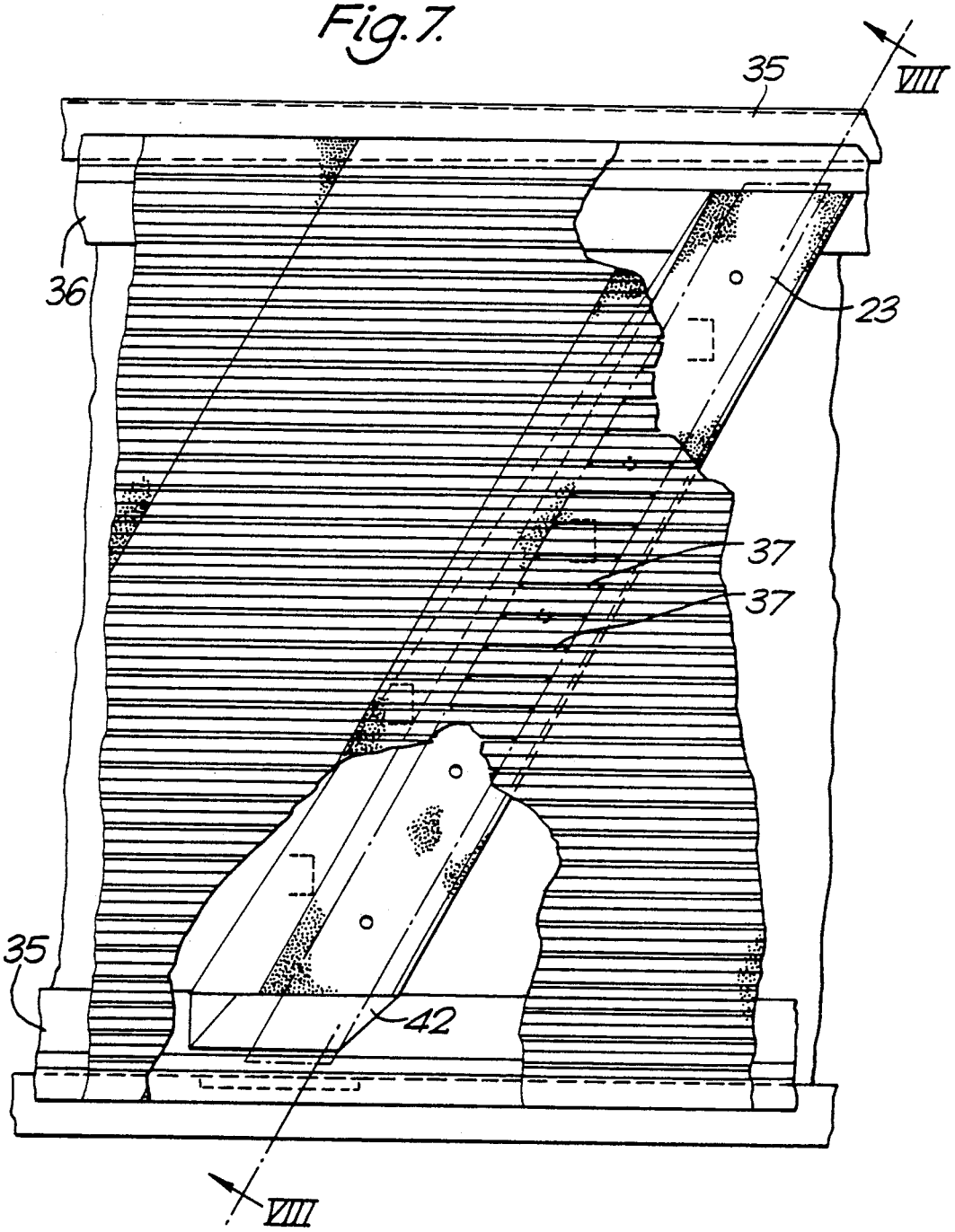
FIG. 7 is a plan view of part of the fluidised bed deck.
Figure 8:
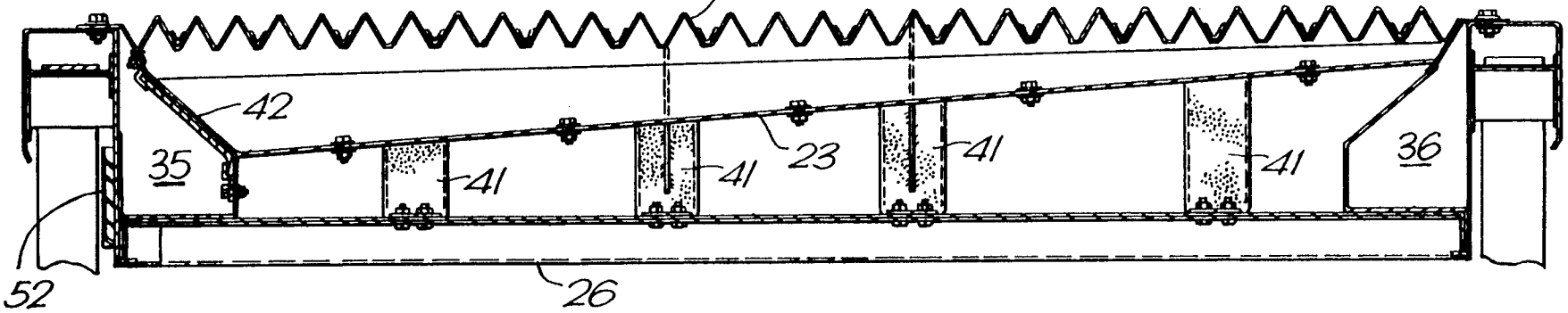
FIG. 8 is a cross-sectional view on the line VIII—VIII of FIG. 7.

The construction of the vibrating deck is shown more clearly in FIGS. 3, 7 and 8. FIG. 3 shows the corrugated deck surface with the peaks of the corrugations indicated by reference numeral 30 and the troughs by reference numeral 31. The bottom 32 of each trough is flat and the whole construction is made from perforated material so that an air flow can be passed through it. As will be seen from FIG. 8, the corrugated surface is carried on the perforated channels 23, which are connected on each side to lengthwise extending box section galleries 35 and 36. Reference to FIG. 7 will show that a row of slots 37 is provided which extends angularly across the deck, each slot being located at the bottom of one of the troughs 31. A collector channel 23 is located beneath each row of slots and additional support is provided by supports 41. It will be seen that this collector channel is angled downwardly towards the gallery 35 and is also angled across the deck. Where the channel meets the gallery 35, a window opening 42 is provided to provide communication between the gallery and the channel. The channel 23 is made from a perforated material to allow an appropriate air flow through it for the fluidised bed.

Figure 4:
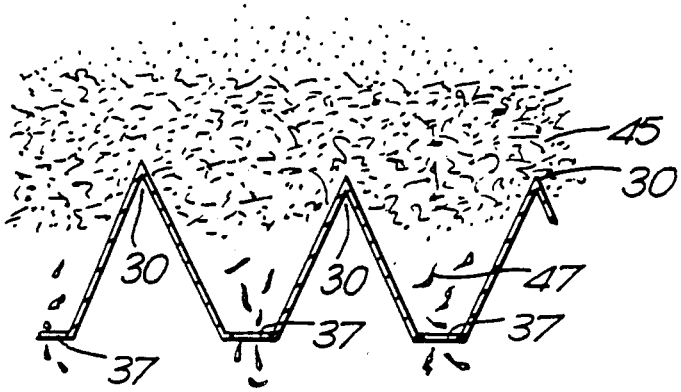
FIG. 4 is a diagrammatic view showing the relative position of a tobacco carpet on the fluidised bed deck.

FIG. 4 shows how the carpet of tobacco material indicated by reference numeral 45 is located by the fluid bed in relation to the corrugated surface provided by the deck of the bed. Approximately one third of the carpet impinges into the channels below the peaks 30 although it will be appreciated that there will be large fragments falling from the lower surface, indicated by reference numeral 47 and dust and other smaller fragments indicated by reference numeral 48 rising above it. As the peaks of the deck extend into the carpet of material, vibration of the deck is transmitted to the material, thus teasing it while it is in a fluid state. Moreover, because the vibration is transmitted to the carpet of material, it helps to move it down the conveyer thus ensuring a rapid throughput of material. It has been found that a relatively thin layer of material transported rapidly through the conveyer is more effective than moving a much thicker layer at slower speed.

Due to the angled construction of the collector channels 23, heavy material which has fallen through the openings 37 is transported across the deck and into the gallery 35 through the appropriate window 42. Because the whole deck is vibrating, the gallery 35 now acts as a conveyer to move the heavy material to the position indicated by reference numeral 8 in FIG. 1 so that it can be removed.

Figure 5:
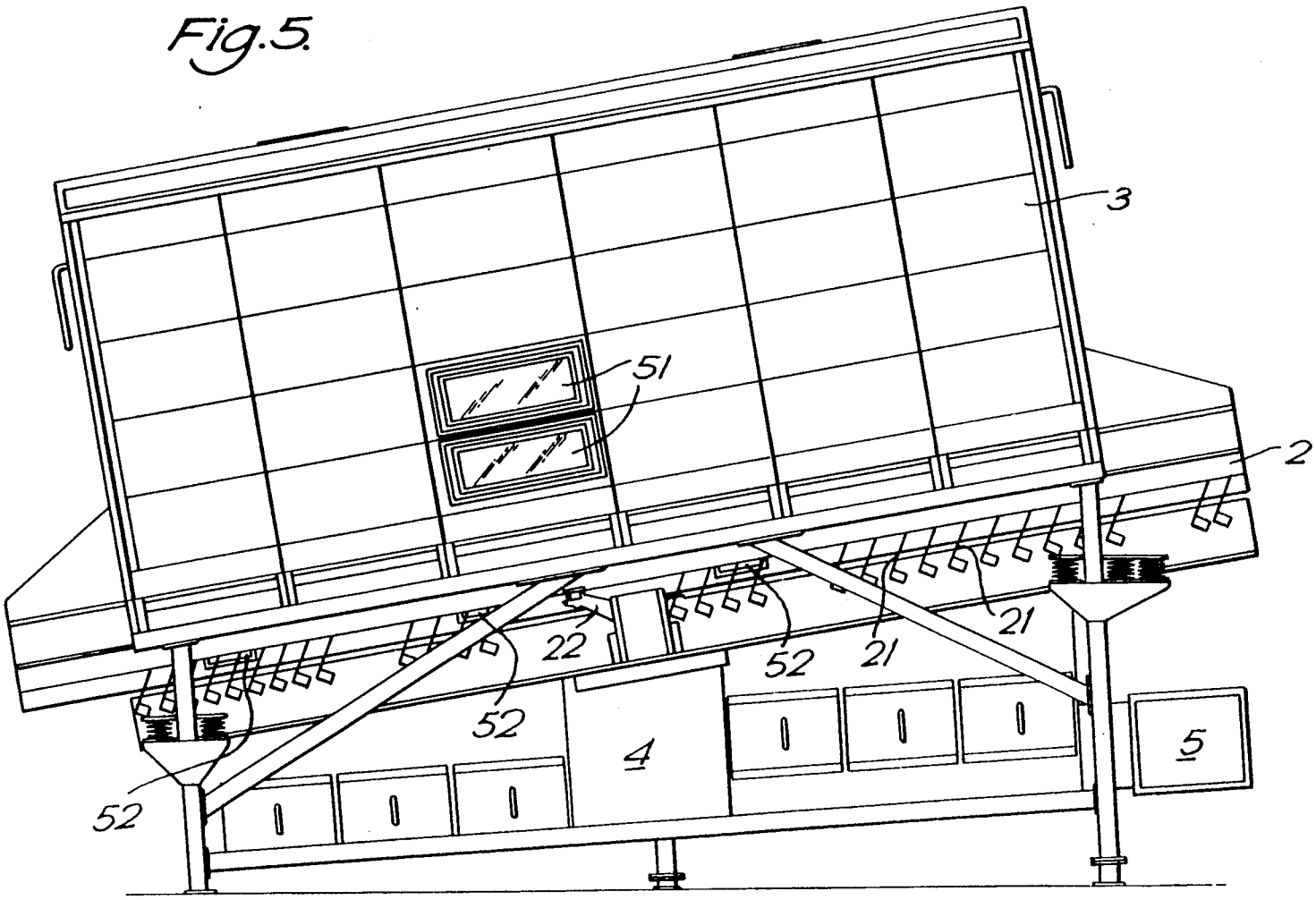
FIG. 5 is a side elevation of a part of the apparatus.

FIG. 5 shows the external construction of the deck together with its hood, the same reference numerals being used to indicate similar parts as the other Figures.

Figure 6:
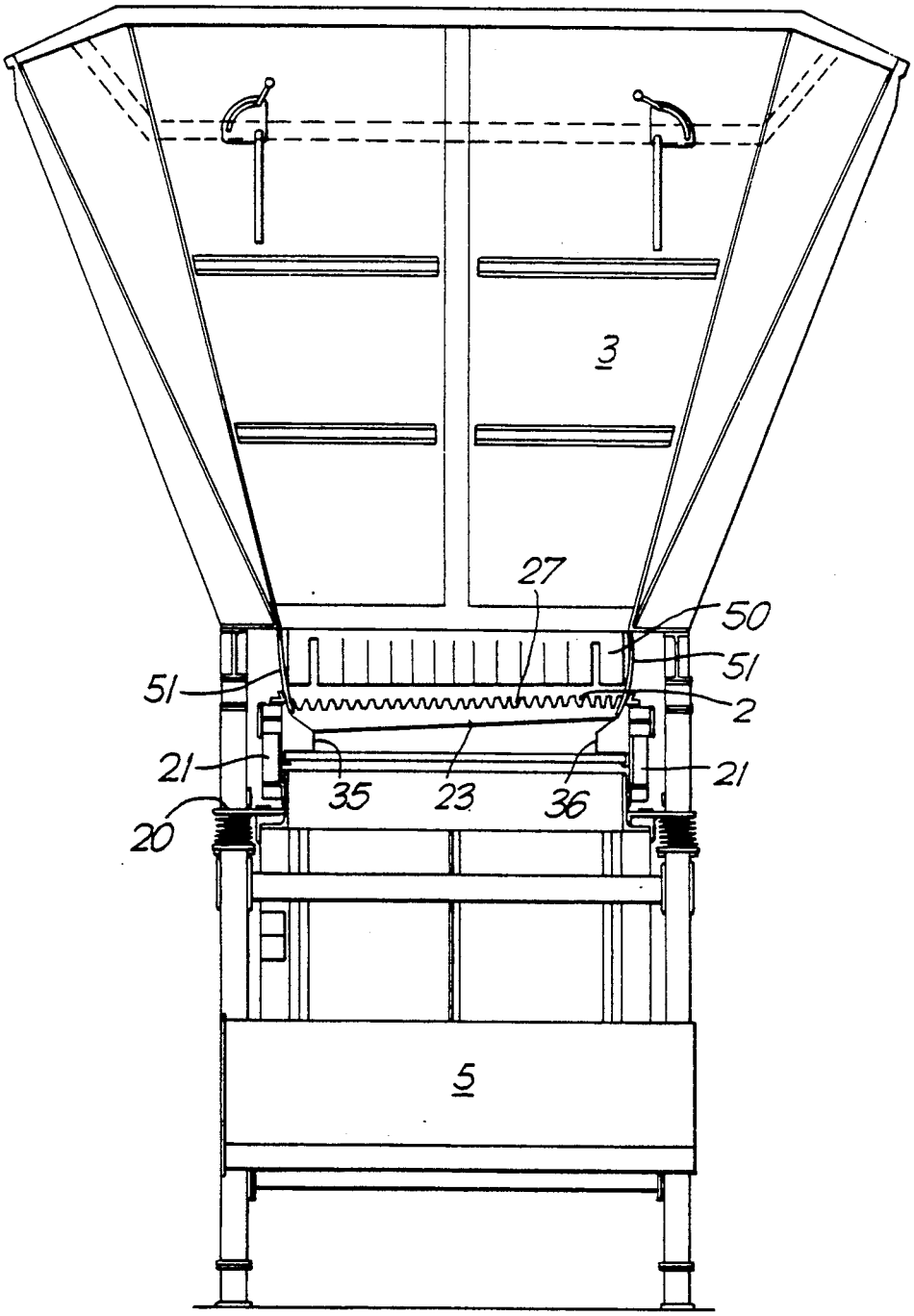
FIG. 6 is an end elevation of the apparatus shown in FIG. 5.

FIG. 6 shows the entry end of the apparatus with a part section through the deck once again employing the same reference numerals as the previous Figures to indicate similar parts. As will be seen from FIG. 6 a nylon skirt 50 is employed at the entrance and exit, and transparent windows can be provided in the hood 3 in order to observe the process. Similarly transparent windows 52 can also be provided in the sides of the gallery 35 opposite the collector troughs 23 for observation purposes. Flexible plastics material rubbing seals 54 are provided between the hood 3 and the vibrating deck 2 and flexible seals (not shown) are also provided between the plenum 4 and the underside of the deck 2.

Figure 9:
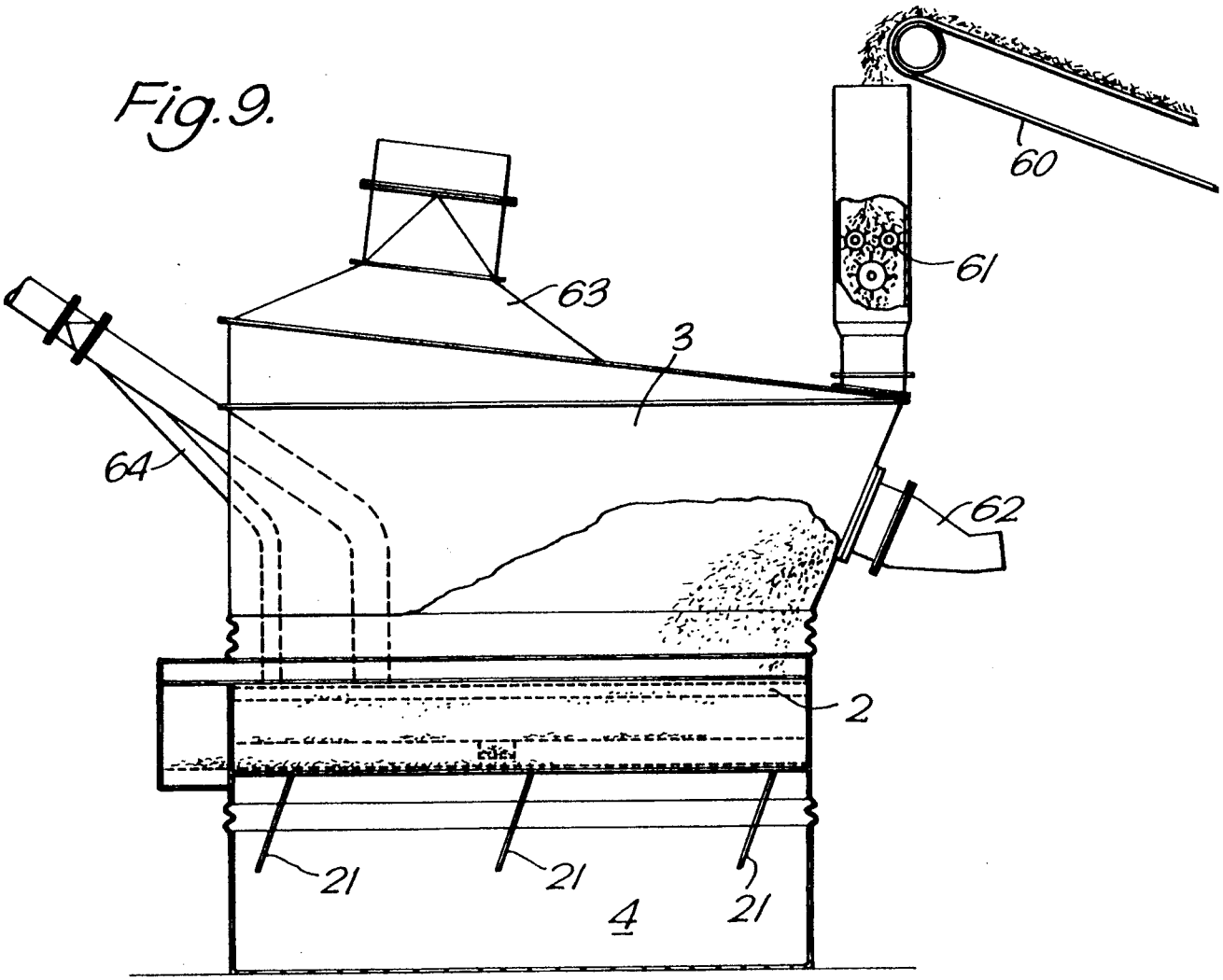
FIG. 9 is a diagrammatic cross-section through a second embodiment.

In an alternative construction shown in FIG. 9 similar reference numerals are used to indicate similar parts as shown in FIGS. 1 and 2. Thus, the deck 2 is surmounted by a hood 3 and air is supplied through a plenum chamber 4. The deck 2 is carried on a spring mounted frame to which it is connected by fiber glass springs 21 in a similar manner to the arrangement shown in FIG. 5 and the deck is vibrated by any suitable means, for example by a drive arm similar to that also shown in FIG. 5.

In this construction tobacco is conveyed via a feed conveyer 60 and it is metred into the apparatus by spiked wheels indicated by reference numeral 61 which will also act to open up the tobacco. If desired the apparatus might also be fitted with an air stream provided through a baffled duct 62 which further opens the tobacco up before it falls onto the fluidised bed 2.

Fluidised air is blown from a fan to the underside of the deck in a similar manner to that described with regard to the other Figures and the deck is perforated in the manner described above or in the manner shown in FIGS. 10 and 11 to be described hereafter. The combination of the perforations and the deck shape cause the fluidised air velocity to increase from the trough to the peaks of the convolutions. Tobacco particles with different aerodynamic qualities will be supported at different air velocities and stratify vertically within the convolutions such that the heavy objectionable particles will be at or near the bottom of the trough and acceptable material at a higher level. Dust is carried off in the air stream through the hood 3 and a hood extraction duct 63 to a fan filter combination, again as described. The hood 3 is flared out to cause the fluidising air velocity to drop with its increase in cross-section thus ensuring that good tobacco is not carried away with the dust.

The objectionable particles again drop through slots in the deck and the vibratory action of the bed ensures that the tobacco is teased open and all particles are transported away from the infeed end.

The carpet of acceptable tobacco particles can again be discharged as described above but in the arrangement shown in FIG. 9 this acceptable material may be gently air lifted in a gentle removal air stream via suction tubes 64. In this arrangement the level of suction is kept to a minimum to limit degradation and also to ensure that any heavy objectionable particles which did not pass through the slots in the bed are left behind on the vibrating deck where they can be channelled off by the vibration and eventually pass off the apparatus with the material which falls through the slots.

The velocity of said gentle air stream will depend upon the cross section of the tube 64 and other factors, for example it can be as low as 200 feet per minute, but in a typical example is about 1,000 feet per minute which is added to the fluidising air stream.

It will be appreciated that the air lift arrangement is very soft and is merely strong enough to gently lift the tobacco away. It is not used in the normal sense or as in known constructions as a separator.

The rate of objectionable material leaving the apparatus may be measured and compared to a desired level in order to provide control by altering the velocity of air fluidising air.

Figure 10:
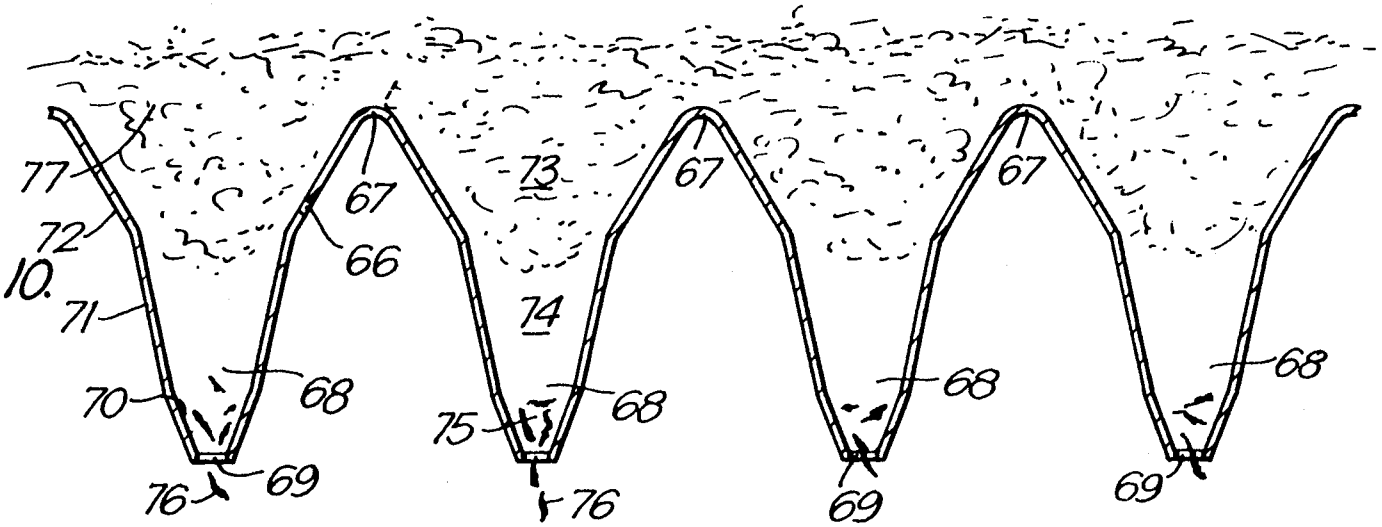
FIG. 10 is a diagrammatic cross-section of an alternative deck configuration; and, FIG. 11 is a diagrammatic cross-section of another deck configuration.

In the trough construction shown in FIG. 10 the material of the deck surface is again perforated, a typical perforation being indicated by reference numeral 66. The peaks of the corrugations are indicated by reference numeral 67 and the trough by reference numeral 68. The bottom of each trough may be flat or curved and, as mentioned above, the whole construction is made from perforated material so that air flow can pass through it. Slots 69 are again provided at the bottom of each trough. As will be seen from the drawing the shape of the peaks and troughs is not triangular, for example as shown in FIG. 4, but each side wall of each trough is multi-angled. Thus at the bottom of each trough there is a first side wall portion 70 which leads into a more upright portion 71 which in turn leads into a more angled portion 72. The included angles between the portions 72 and 71 and 71 and 70 are different. The upper end of the trough 62 is rounded to lead into the next side wall. In cross-section the trough therefore has a wider angle at the area indicated by reference numeral 73 than in the middle portion 74 and it is even more restricted in the lower portion 75. The net result of this shaping is that the air velocity at the lower part of the trough is greater than at the top and this is pronounced and provides better separation between the bottom of the trough through which unwanted particles, indicated by reference numeral 76, can fall through the openings 69 and the upper part of the trough where the carpet of tobacco, indicated by reference numeral 77, can float and be vibrated.

Figure 11:
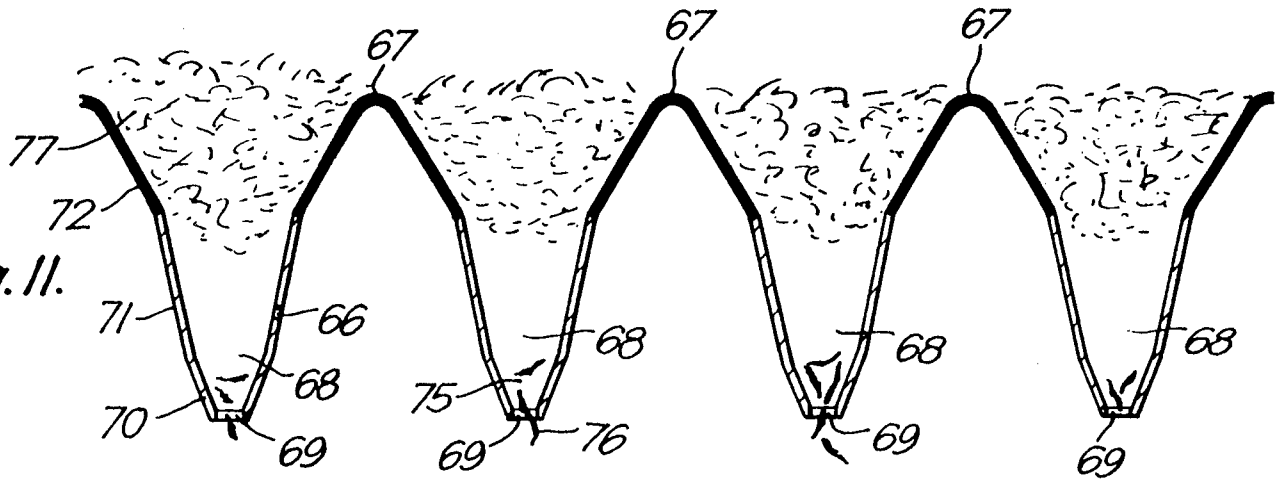

A similar construction is shown in FIG. 11 and the same reference numerals are used to indicate similar parts but in this construction the upper ends of the peaks carry no air perforations and are shown in solid lines. This portion of each peak incorporating the more angled parts of the side walls indicated by reference numeral 72. This construction offers the advantage that less air flow is required and a better separation is obtained between the bottom of the trough 69 and the carpet of tobacco 77. Moreover, the carpet of tobacco tends to lie more evenly in the upper part of the troughs so that it is contained.

I claim:

1. Apparatus for the separation of objectionable particles from tabacco material which comprises a deck adapted to receive thereon tabacco material, means for vibrating said deck, means for providing an air flow through the deck to fluidize the tabacco material, said deck having a convoluted and at least partly perforated surface which provides peaks and troughs, the air velocity of said fluidizing air and said peaks and troughs providing stratified air velocities over the deck to cause the tabacco material to form a carpet at least a portion of which is below the peaks but spaced above the bottom of the troughs and which together with the vibration of the deck agitates the carpet and causes the dust to be released and rise and heavy particles to sink, said carpet moving lengthwise along said troughs during operation toward a discharge location, means for removing the dust, and means for removing the heavy particles through the deck.

2. Apparatus as claimed in claim 1 in which the combination of the shape of the deck convoluted surface and the perforations therein cause the velocity of the fluidizing air to increase from the troughs to the peaks.

3. Apparatus as claimed in claim 1 including means for lifting acceptable material from the carpet on a gentle removal air stream and transporting it from the discharge location.

4. Apparatus as claimed in claim 1, in which the peaks are not perforated.

5. Apparatus as claimed in claim 4 in which the dust is removed through a tapered extraction hood in which air velocity at its higher level is less than the air velocity at its lowest level.

6. Apparatus as claimed in claim 1 in which heavy particles are delivered to a classifier for segregation and re-cycling.

7. Apparatus as claimed in any one of claims 1 to 6 in which means are provided for smoothing the flow of and pre opening the tobacco material.

8. Apparatus as claimed in claim 7 in which said smoothing means act to spread the incoming material on said vibrating deck and include deflectors.

9. Apparatus as claimed in claim 8 in which means are provided to pass the material across an air stream after said spreading means.

10. Apparatus as claimed in claim 7 in which said smoothing means includes a spiked belt or spreader wheels, or rollers.

11. Apparatus as claimed in claim 1 in which said heavy particles are removed through openings in said deck.

12. Apparatus as claimed in claim 11, in which said openings in the deck are in the form of slots in the troughs.

13. Apparatus as claimed in claim 12 in which the heavy particles pass through the slots to a collector which removes them to at least one side or end of the vibrating deck.

* * * * *